US006211628B1

(12) United States Patent
Harris et al.

(10) Patent No.: US 6,211,628 B1
(45) Date of Patent: Apr. 3, 2001

(54) SYSTEM FOR CONTROLLING THE POSITION OF AN ELECTRON BEAM IN A CATHODE RAY TUBE AND METHOD THEREOF

(75) Inventors: J. Michael Harris, Elmira; Michael Teter, Painted Post, both of NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/124,379

(22) Filed: Jul. 28, 1998

Related U.S. Application Data

(60) Provisional application No. 60/054,603, filed on Aug. 2, 1997.

(51) Int. Cl.[7] ..... G09G 1/04

(52) U.S. Cl. ..... 315/369; 315/382.1; 313/446

(58) Field of Search ..... 315/369, 382.1, 315/14, 366, 382; 348/811, 812; 313/441, 446, 458, 460, 479

(56) References Cited

U.S. PATENT DOCUMENTS

| | | | | |
|---|---|---|---|---|
| 3,614,519 | | 10/1971 | Figlewicz et al. | 315/8 |
| 3,621,318 | | 11/1971 | Lewinson | 313/64 |
| 3,792,300 | | 2/1974 | Benda et al. | 313/85 |
| 3,802,757 | | 4/1974 | Benda et al. | 316/14 |
| 3,914,651 | * | 10/1975 | Washburn | 315/371 |
| 3,979,632 | | 9/1976 | Gunning et al. | 313/479 |
| 4,101,803 | | 7/1978 | Retsky et al. | 315/3 |
| 4,153,857 | | 5/1979 | Delsing et al. | 313/481 |
| 4,207,493 | | 6/1980 | Förster | 315/3 |
| 4,217,521 | | 8/1980 | Dietch et al. | 313/479 |
| 4,234,816 | | 11/1980 | Fischman | 313/479 |
| 4,251,749 | | 2/1981 | Compen et al. | 313/479 |
| 4,276,494 | | 6/1981 | van Roosmalen et al. | 313/479 |
| 4,374,344 | | 2/1983 | Misono et al. | 313/479 |
| 4,403,170 | | 9/1983 | Misono et al. | 313/479 |
| 4,449,148 | * | 5/1984 | Inohara et al. | 358/230 |
| 4,471,264 | | 9/1984 | Matsuzaki et al. | 315/3 |
| 4,635,107 | | 1/1987 | Turner | 358/68 |
| 4,745,344 | * | 5/1988 | Tomii et al. | 315/366 |
| 4,857,797 | | 8/1989 | Vrijssen et al. | 313/450 |
| 4,973,889 | * | 11/1990 | Tomii et al. | 315/366 |
| 4,977,348 | | 12/1990 | Odenthal | 313/479 |
| 4,988,915 | | 1/1991 | Zegers | 313/479 |
| 4,988,928 | | 1/1991 | Vrijssen et al. | 315/382 |
| 4,988,929 | | 1/1991 | Spanjer et al. | 315/382 |
| 5,015,925 | | 5/1991 | Spanjer et al. | 315/382 |
| 5,025,490 | | 6/1991 | Tamura | 313/479 |
| 5,198,729 | | 3/1993 | Powell | 315/370 |
| 5,220,242 | | 6/1993 | Choi | 313/479 |
| 5,254,903 | | 10/1993 | Jo et al. | 313/450 |
| 5,300,856 | | 4/1994 | Bartch et al. | 313/479 |
| 5,357,166 | | 10/1994 | Sugahara et al. | 313/479 |
| 5,365,285 | | 11/1994 | Kizuya et al. | 348/818 |

* cited by examiner

*Primary Examiner*—Seungsook Ham
(74) *Attorney, Agent, or Firm*—Gunnar G. Leinberg; Angela N. Nwaneri

(57) ABSTRACT

A system and method for controlling an electron beam in accordance with the present invention includes an electron gun, a cathode ray tube with a faceplate, a deflection drive, a pair of positioning electrodes, an electron beam controller, and a pair of capacitors. The electron gun generates an electron beam in the cathode ray tube which is deflected in a desired direction towards and between at least one pair of positioning electrodes formed on the inner surface of the faceplate. Each of the positioning electrodes generates a position signal which is capacitively coupled by the capacitors to the electron beam controller. The electron beam controller adjusts the deflection of the electron beam in response to the position signals. The capacitors comprise a pair of first and second capacitor plates which are separated by the cathode ray tube. The first capacitor plates are disposed on opposing sides of an inner surface of the cathode ray tube adjacent to the faceplate. The second capacitor plates are disposed on the outer surface of the cathode ray tube, each of the second capacitor plates being disposed opposite one of the first capacitor plates.

18 Claims, 5 Drawing Sheets

SYSTEM FOR CONTROLLING THE POSITION OF AN ELECTRON BEAM IN A CATHODE RAY TUBE AND METHOD THEREOF

This Application claim benefit to Provisional Application 60/054,603 filed Aug. 2, 1997.

FIELD OF THE INVENTION

This invention relates to a system and method for detecting and controlling the position of an electron beam in a cathode ray tube using capacitive coupling.

BACKGROUND OF THE INVENTION

A conventional color television tube has a cathode ray tube, three electron guns (i.e., one gun for the red image, a second gun for the green image, and a third gun for the blue image) and a shadow mask or aperture grill which serves to block the three electron beams produced by the guns from hitting the wrong phosphors on an inner surface of a faceplate of the cathode ray tube. While the shadow mask acts as an effective block, it causes some difficulties.

For example, approximately eighty percent of the total electron beam current produced by a gun hits the shadow mask and is dissipated therein as heat. This heating causes the shadow mask to expand. The process is called doming and results in an upper limit on the tube's brightness because as higher electron beam currents are used to achieve greater brightness, more expansion occurs and causes the shadow-mask to eventually lose its registration with the phosphors on the faceplate.

The shadow mask also limits the resolution of the display, which depends on the number and size of the holes in the mask. There are plainly only so many holes that one can put in the mask and still keep it stiff. Also, as the hole size decreases, less of the electron beam reaches the phosphor, thus lowering the brightness.

Without a shadow mask, the problems with doming and resolution are eliminated. However, without a shadow mask proper positioning of the electron beam becomes more crucial. To properly position the electron beam, it is necessary to be able to determine and adjust the position of the electron beam.

One technique for controlling the position of the electron beam involves detecting light on the outer surface of the faceplate of cathode ray tube when the electron beam strikes a phosphor. The detected light is then converted to a position signal indicating the position of the electron beam on the faceplate. The position signal is then compared against a desired location signal for the electron beam, an error signal is generated and the error signal is used to correct the positioning of the electron beam. One of the main problems with this technique is that it requires an expansive detection system outside of and separate from the cathode ray tube to control the position of the electron beam which renders it not commercially feasible.

Another technique for controlling the position of the electron beam involves generating an electronic current as the electron beam hits an electrode on the faceplate of the cathode ray tube and then coupling this current out from the cathode ray tube using transformers. One example of such a system is disclosed in U.S. Pat. No. 4,635,107 to Turner, which is herein incorporated by reference.

Although the technique using transformers works, it has problems. For example, the transformers used in this technique are expensive because they must be able to faithfully transform a few microamps of current into detectable levels of currents while successfully withstanding potential differences of twenty-five kilovolts or more. Additionally, the leads from the transformers must pass through the cathode ray tube to get to the current signal from the electrodes out.

SUMMARY OF THE INVENTION

A system and method for controlling an electron beam in accordance with the present invention includes an electron gun, a cathode ray tube with a faceplate, a deflection drive, a pair of positioning electrodes, an electron beam controller, and a pair of capacitors. The electron gun generates an electron beam in the cathode ray tube which is deflected in a desired direction towards and between at least one pair of positioning electrodes formed on the inner surface of the faceplate. Each of the positioning electrodes generates a position signal which is capacitively coupled by the capacitors to the electron beam controller. The electron beam controller adjusts the deflection of the electron beam in response to the position signals. The capacitors comprise a pair of first and second capacitor plates which are separated by the cathode ray tube. The first capacitor plates are disposed on opposing sides of an inner surface of the cathode ray tube adjacent to the faceplate. The second capacitor plates are disposed on the outer surface of the cathode ray tube, each of the second capacitor plates being disposed opposite one of the first capacitor plates.

The system and method in accordance with the present invention provides a number of advantages, including providing an inexpensive and effective control system for the position of an electron beam in a cathode ray tube. Instead of the prior system of using transformers which are expensive and require leads to pass through the cathode ray tube, the present invention uses a pair of capacitors formed on the funnel of the cathode ray tube at a minimal cost, i.e. only the cost of metallization to form the capacitor plates in and on the funnel of the cathode ray tube, and which can transfer the position signals generated by the electron beam in the cathode ray tube externally from the cathode ray tube without requiring leads to pass through the cathode ray tube.

DETAILED DESCRIPTION OF THE INVENTION

Figure 1:
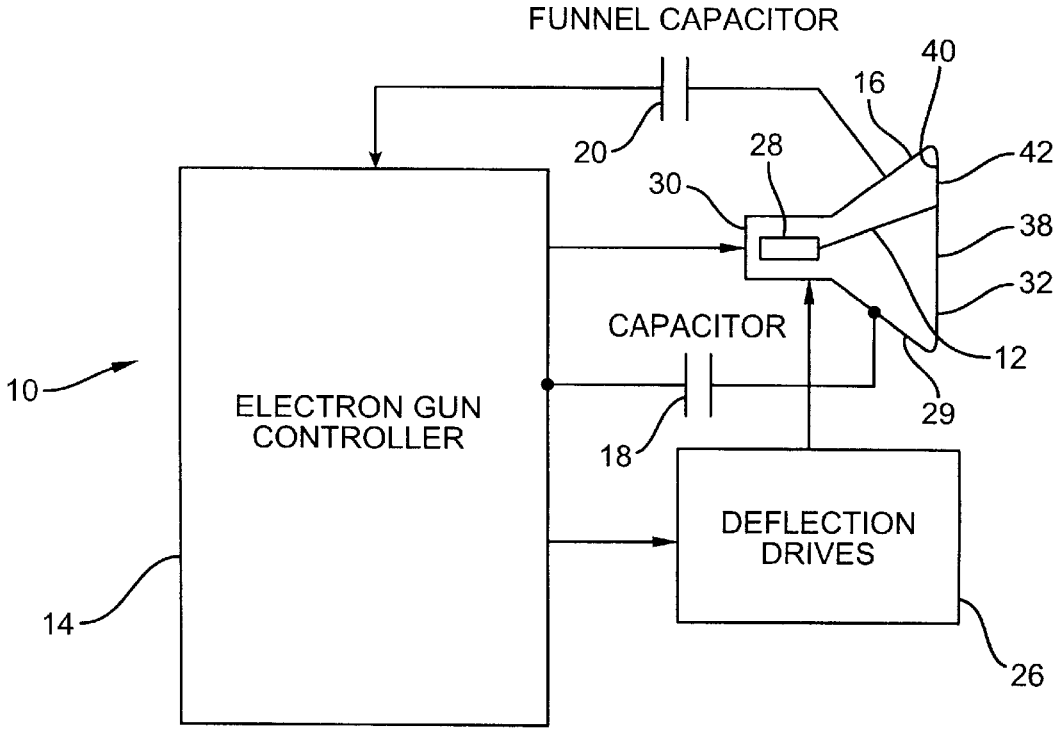
FIG. 1 is a partial schematic and partial block diagram of a system for controlling an electron beam in a cathode ray tube in accordance with the present invention.

A system 10 for controlling an electron beam 12 in accordance with the present invention is illustrated in FIG.

1. The system 10 includes an electron gun controller 14, a cathode ray tube 16, at least one capacitor 18, optionally, a second capacitor 20, and at least one pair of positioning electrodes 22 and 24. The system and method provide a number of advantages including providing an effective and inexpensive system and method for detecting and controlling the position of an electron beam 12 in a cathode ray tube 16.

It is to be noted that although FIGS. 1 and 2 show a pair of capacitors comprised of elements 18, 18(2), 20, and 20(2), it is well within the scope of applicants' invention to operate with only one capacitor when the electronics so permit. This will become evident in the discussion of the electrode pattern shown in FIG. 4A.

Referring more specifically to FIGS. 1 and 2A, 2B, 3A, and 3B, the system 10 includes the electron gun controller 14, a deflection drive 26, and an electron gun 28. The electron gun controller 14 is coupled to the electron gun 28 in one end of the cathode ray tube 16, to a second plate 18(2) and 20(2) of a pair of capacitors 18 and 20, and to the deflection drive 26. The electron gun controller 14 includes control circuitry used to control the position of the electron beam 12 and to correct for any errors in the electron beam's position based upon the electron beam's detected location. The electron gun controller 14 transmits control signals to the electron gun 28 and to the deflection drive 26 to, inter alia, control the intensity or brightness of and the position of the electron beam 12 generated by the electron gun 28. Typically, the electron beam 12 has a current of only a few microamps and the high voltage applied between the cathode and anode in the cathode ray tube 16 is between about ten and thirty kilovolts. The general construction and operation of the electron gun controller 14, the deflection drive 26, and the electron gun 28 to generate and control the position of the electron beam 12 at horizontal and vertical locations are well known to those skilled in the art, such as those disclosed in U.S. Pat. No. 4,635,107 to Turner which has already been incorporated by reference, and thus will not be described in detail here.

Figure 2A:
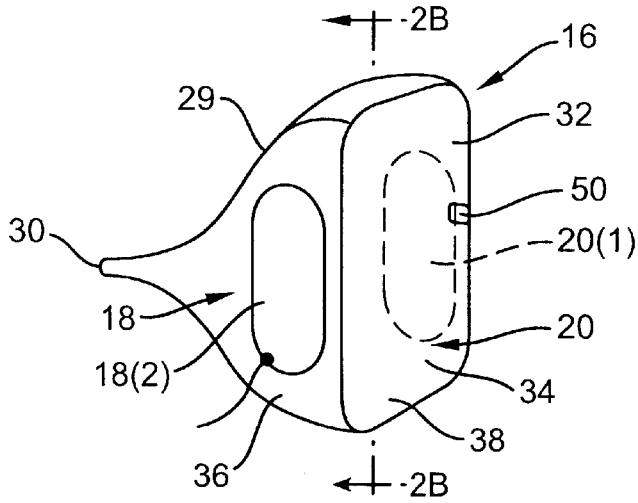
FIG. 2A is a perspective view of the cathode ray tube in accordance with the present invention.
Figure 2B:
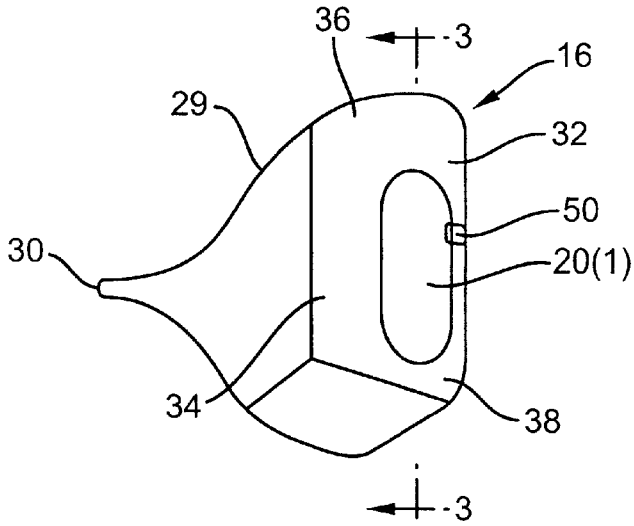
FIG. 2B is a cross-sectional view of the cathode ray tube taken along lines 2B—2B in FIG. 2A.

Referring to FIGS. 1, 2A, and 2B, the system 10 includes the cathode ray tube 16. The cathode ray tube 16 has a substantially, "funnel-like" shape or funnel 29 with a pair of opposing ends 30 and 32, an inner surface 34, and an outer surface 36. The narrow end 30 of the cathode ray tube 16 houses the electron gun 28 which is coupled to the electron gun controller 14. The electron gun 28 generates the electron beam 12 which is transmitted towards the other, wider end 32 of the funnel 29 of the cathode ray tube 16. The deflection drive 26 is also located adjacent to the end 30 of the cathode ray tube 16 with the electron gun 28. A faceplate 38 is secured to the other, wider end 32 of the cathode ray tube 16. The faceplate 38 also has an inner surface 40 and an outer surface 42. One or more phosphors, depending upon whether or not a monochrome or color screen is desired, are coated on the inner surface 40 of the faceplate 38 in a manner well known to those skilled in the art. A general discussion of the construction and operation of cathode ray tubes can be found in *The Cathode Ray Tube* by Peter A Keller, Palisades Press, New York, N.Y., 1991, which is herein incorporated by reference.

Figure 3A:
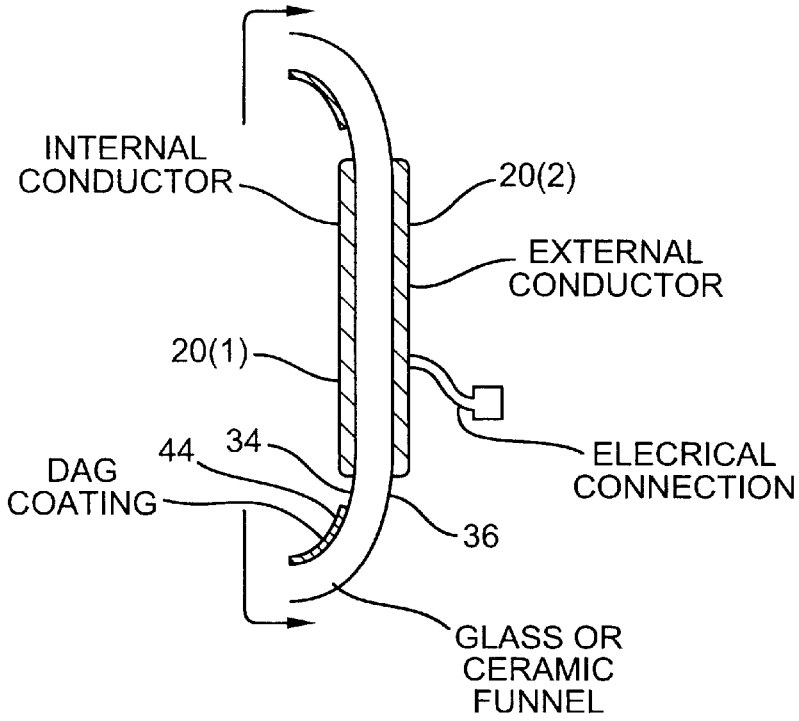
FIG. 3A is cross-sectional view of the cathode ray tube with a capacitor taken along lines 3—3 in FIG. 2B.
Figure 3B:
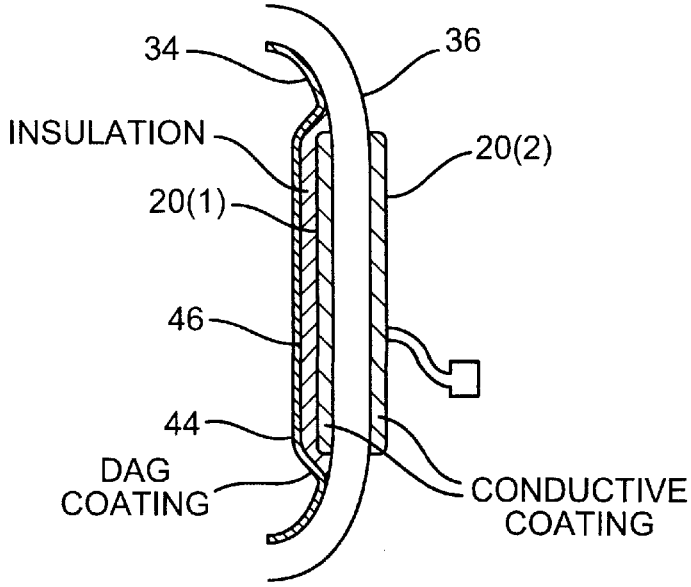
FIG. 3B is cross-sectional view of the cathode ray tube with another embodiment of the capacitor taken along lines 3—3 in FIG. 2B.

Referring to FIGS. 1, 2A, 2B, 3A, and 3B, the pair of capacitors 18 and 20 are located on opposite sides of the funnel 29 of the cathode ray tube 16 adjacent to the faceplate 38. The capacitors 18 and 20 are shown separate from the cathode ray tube 16 in FIG. 1 simply for ease of illustration, but are actually formed on the cathode ray tube 16 as discussed below. A first capacitor plate 18(1) and 20(1) for each capacitor 18 and 20 is located inside the cathode ray tube 16 on the inner surface 34 of the funnel 29 of the cathode ray tube 16. For ease of illustration, only a cross-sectional view of capacitor 20 is illustrated in FIGS. 3A and 3B, however capacitor 18 has an identical construction on the opposite side of funnel 29. The first capacitor plates 18(1) and 20(1) are located on opposite sides of the cathode ray tube 16. Second capacitor plates 18(2) and 20(2) are located on the outer surface 36 of the funnel 29. Each of the second capacitor plates 18(2) and 20(2) is disposed substantially opposite one of the first capacitor plates 18(1) and 20(1). In this particular embodiment, the first and second capacitor plates 18(1), 20(1), 18(2), and 20(2) each have an area of about ten square inches each, although the size of the first and second capacitor plates 18(1), 20(1), 18(2), and 20(2) can vary as needed or desired.

The funnel 29 is typically formed of ceramic or glass and the funnel 29 acts as the dielectric between the first and second capacitor plates 18(1), 20(1), 18(2), and 20(2). In this particular embodiment, the funnel 29 is made of lead glass which has a dielectric constant of about eight to ten.

Each of the capacitors 18 and 20 is designed to withstand the high voltage differences typically found between the cathode and anode in the cathode ray tube 16, i.e. in this particular embodiment a difference of about twenty-five Kilovolts. Typically, a capacitance of a few hundred picofarads is sufficient for each capacitor 18 and 20 to detect the position signal when the electron beam 12 strikes one of the positioning electrodes 22 and 24 coupled to the capacitor 18 and 20 by capacitive coupling of the electron beam 12.

As shown in FIG. 3A, a coating 44 slurry of fine carbon in $Na_2SiO_3$ paint and fire and is a conductive coating may coat the inner surface 34 of the funnel 29, except for the regions where the first capacitor plate 20(1) is located or an insulating layer 46 may be placed over the first capacitor plate 20(1) inside the cathode ray tube 16 and then the coating 44 may cover the first capacitor plate 20(1) as shown in FIG. 3B. The coating may be of the conventional DAG used in CRT manufacture. It is generally a slurry of fine carbon particles in sodium silicate which may be painted on and fired. Although two embodiments are illustrated, other coating and insulating arrangements may also be used.

One of the features of the present invention is that the cost of the capacitors 18 and 20 is minimal, i.e. basically being just the cost of metallization to form the first and second capacitor plates 18(1), 20(1), 18(2), and 20(2) in and on the cathode ray tube 16 and the cost of lead attachments 48 and 50 coupling the first capacitor plates 18(1) and 20(1) each to one of each pair of positioning electrodes 22 and 24, and is substantially less than the cost of the prior art technique using transformers. Additionally, by using capacitors 18 and 20, rather than transformers, leads do not need to be passed through the cathode ray tube 16 to couple signals generated inside the cathode ray tube 16 externally.

Figure 4A:
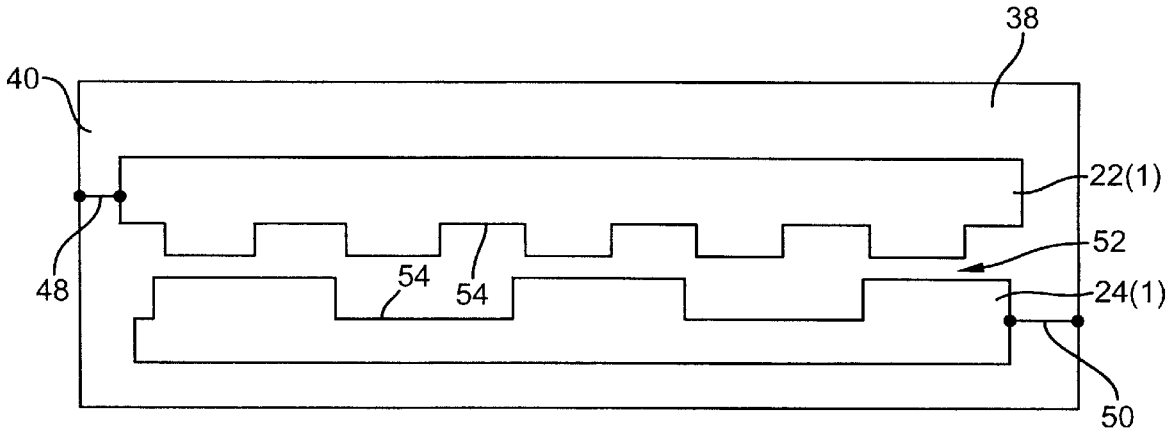
FIG. 4A is a diagram illustrating one embodiment of a pair of electrodes on an inner surface of a faceplate of the cathode ray tube.
Figure 4B:
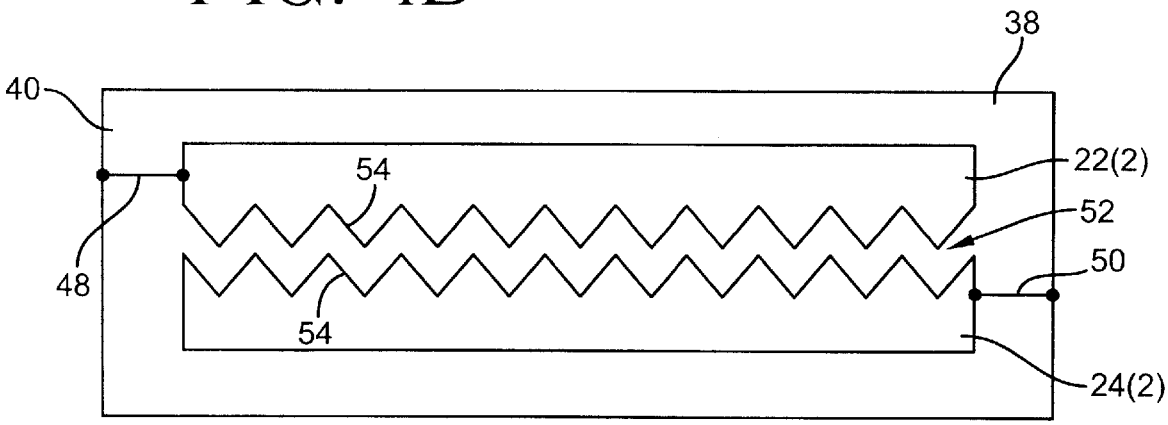
FIG. 4B is a diagram illustrating another embodiment of a pair electrodes on an inner surface of the faceplate of the cathode ray tube.
Figure 4C:
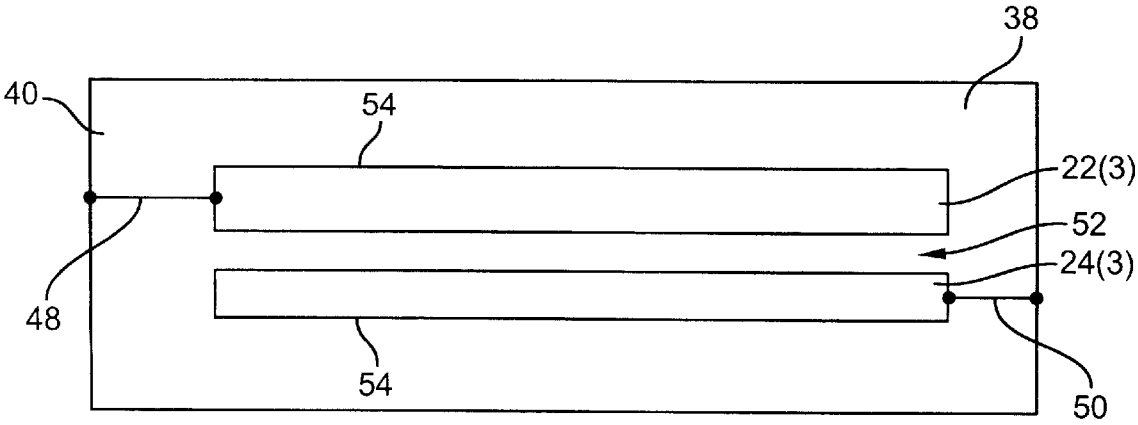
FIG. 4C is a diagram illustrating yet another embodiment of a pair electrodes on an inner surface of the faceplate of the cathode ray tube.

Referring to FIGS. 4A, 4B, and 4C, three different embodiments for positioning electrodes 22 and 24 are illustrated. As shown in these figures, the inner surface 40 of the faceplate 38 includes at least one pair of positioning electrodes 22 and 24 which extend in a substantially horizontal direction across the inner surface 40 of the faceplate 38 and are separated be a gap or first distance 52. In this particular embodiment, the gap or first distance 52 ranges between about 0.015 and 0.075. Phosphors (not shown) are coated on the inner surface 40 of the faceplate 38 between each pair of positioning electrodes 22 and 24. By way of example, in a color screen or faceplate 38 the gap 52 between each pair of positioning electrodes 22 and 24, a red substantially horizontal stripe of phosphor (not shown), a green substantially horizontal stripe of phosphor (not shown), and a blue substantially horizontal stripe of phosphor (not shown) are formed. One positioning electrode 22(1)–22(3) is coupled to one of the first capacitor plates 18(1) and the other positioning electrode 24(1)–24(3) is coupled to the other first capacitor plate 20(1) via leads 48 and 50, respectively. Although only one pair of positioning electrodes 22 and 24 is shown in each example, the faceplate 38 can have more than one pair of positioning electrodes 22 and 24. By way of example, a television screen may have about 480 pairs of positioning electrodes 22 and 24. If multiple pairs of positioning electrodes 22 and 24 are used, one electrode 22 from each pair is coupled typically to a bus (not shown) which is coupled to one first capacitor plate 18(1) and the other electrode 24 from each pair is also typically coupled to another bus (not shown) which is coupled to the other first capacitor plate 20(1).

The positioning electrodes 22 and 24 may have a variety of different shapes. For example, as illustrated in FIGS. 4A, 4B, and 4C and also as discussed in copending patent application Serial No. 60/041,035, filed on Mar. 21, 1997 for a Mask-Free, Single Gun Color Television System, which is herein incorporated by reference, the edge 54 of each positioning electrode 22 and 24 facing its pair may have variety of shapes, such as a squared and stepped configuration, a sawtooth configuration, a substantially straight configuration, or a variety of other configurations as needed or desired. As discussed in greater detail below, if the electron beam 12 is not modulated then a patterned configuration, such as the squared and stepped configuration or the sawtooth configuration shown in FIGS. 4A and 4B, is formed in the edge 54 of each positioning electrode 22 and 24 facing the other to modulate the constant intensity electron beam 12. If the electron beam 12 is modulated, then a substantially straight configuration may be used shown in FIG. 4C. In this particular embodiment, the electron beam is modulated at a frequency of about ten MHz.

The operation of the system 10 and method for controlling the electron beam 12 will be discussed with reference to FIGS. 1–4. The electron gun controller 14 transmits control signals to the electron gun 28 in the cathode ray tube 16 to generate an electron beam 12. The electron beam 12 is deflected in a desired direction by the deflection drive 26 in response to additional control signals from the electron gun controller 14. Typically, the electron gun controller 14 in conjunction with the deflection drive 26 control the electron beam 12 to scan across the faceplate 38 in a pattern, such as a raster scan pattern or a serpentine pattern, as discussed in copending patent application Serial No. 60/041,035, filed on Mar. 21, 1997 for a Mask-Free, Single Gun Color Television System, which has already been incorporated by reference. To facilitate detection of the electron beam 12, the electron beam 12 is modulated in intensity. Preferably, the electron beam 12 is modulated at a frequency of between about five to fifty MHz. Alternatively, the edge 54 of each positioning electrode 22 and 24 facing the gap 52 is patterned, such as the squared and stepped configuration or the sawtooth configuration illustrated in FIGS. 4A and 4B, so that the constant intensity electron beam 12 is converted to an AC signal at the capacitor 18 and 20.

The electron beam 12 is directed to strike one of the stripes of phosphors between the positioning electrodes 22 and 24. If the electron beam 12 misses the gap 52 and strikes one of a pair of the of positioning electrodes 22 and 24, then the positioning electrode 22 and 24 which is struck converts the electron beam 12, which is either modulated in intensity before striking the faceplate 38 or by the patterned positioning electrode 22 or 24, into a first position signal. The first position signal is capacitively coupled via the capacitor 18 or 20 coupled to the positioning electrode 22 or 24 to the electron gun controller 14. The first position signal is separated from the high DC voltage required to generate the electron beam 12 which typically ranges between ten and thirty kilovolts. The other of the pair of positioning electrodes 22 or 24, will generate a second position signal that indicates that it was not struck by the electron beam 12. The second position signal will be capacitively coupled via the other capacitor 18 or 20 to the electron gun controller 14.

The electron gun controller 14 receives the first and second position signals and in response to these position signals, transmits control signals to the electron gun 28 and to the deflection drive 26 to adjust the position of the electron beam 12 to the gap between the positioning electrodes 22 and 24 to strike the phosphors. By way of example, if the electron beam 12 strikes positioning electrode 22, then the first position signal will be high and the second position signal will be low. As a result, the electron gun controller 14 will transmit control signals so that the electron beam 12 is directed down towards the gap 52. If the electron beam 12 strikes positioning electrode 24, then the second position signal will be high and the first position signal will be low. As a result, the electron gun controller 14 will transmit control signals so that the electron beam 12 is directed up towards the gap 52. If the electron beam 12 strikes the gap 52, then the first and second position signals will be low. As a result, the electron gun controller 14 will not adjust the position of electron beam 12. Accordingly, the present invention provides an inexpensive and effective method for controlling the position of the electron beam in a cathode ray tube 16 without a shadow mask.

Having thus described the basic concept of the invention, it will be readily apparent to those skilled in the art that the foregoing detailed disclosure is intended to be presented by way of example only, and is not limiting. Various alterations, improvements and modifications will occur and are intended to those skilled in the art, though not expressly stated herein. These modifications, alterations and improvements are intended to be suggested hereby, and are within the spirit and scope of the invention. Accordingly, the invention is limited only by the following claims and equivalents thereto.

What is claimed is:

1. A system for controlling an electron beam in a cathode ray tube comprising:

a funnel with a pair of opposing ends, an inner surface, and an outer surface;

a faceplate secured to one of the opposing ends of the funnel, the faceplate having inner and outer surfaces;

an electron gun generating an electron beam in the cathode ray tube;

a deflection drive deflecting the electron beam in a desired direction towards the faceplate in the cathode ray tube;

a pair of electrodes formed on the inner surface of the faceplate, each of the electrodes generating a position signal;

an electron beam controller adjusting the deflection of the electron beam in response to the position signals; and at least one capacitor coupling the position signals to the electron beam controller, the at least one capacitor comprising a first inner capacitor plate on at least a portion of the inner surface of the funnel for the cathode ray tube and a first outer capacitor plate on at least a portion of the outer surface of the funnel for the cathode ray tube substantially opposite the first inner capacitor plate.

2. The system as set forth in claim 1 further comprising another capacitor which comprises a second inner capacitor plate on at least a portion of the inner surface of the funnel of the cathode ray tube and a second outer capacitor plate on at least a portion of the outer surface of the funnel of the cathode ray tube substantially opposite the second inner capacitor plate.

3. The system as set forth in claim 1 wherein each of the electrodes has a substantially straight configuration.

4. The system as set forth in claim 3 further comprising means for modulating the electron beam.

5. The system as set forth in claim 4 wherein the electron beam is modulated to have a frequency ranging between one MHz and fifty MHz.

6. The system as set forth in claim 1 wherein each of the electrodes has an edge facing the other which has a substantially saw-tooth configuration.

7. The system as set forth in claim 1 wherein each of the electrodes has an edge facing the other which has a substantially, squared and stepped configuration.

8. A method for controlling an electron beam in a cathode ray tube comprising the steps of:

generating an electron beam in the cathode ray tube;

deflecting the electron beam in a desired direction towards a faceplate in the cathode ray tube, generating at least one position signal when the electron beam strikes one of a pair of electrodes formed on an inner surface of the faceplate;

capacitively coupling the position signal to an electron beam controller through a funnel of the cathode ray tube; and adjusting the deflection of the electron beam in response to the position signal.

9. The method as set forth in claim 8 further comprising the step of modulating the electron beam.

10. The method as set forth in claim 9 wherein the electron beam is modulated to have a frequency ranging between five MHz and fifty MHz.

11. The method as set forth in claim 8 wherein each of the electrodes has an edge facing the other which has a substantially saw-tooth configuration.

12. The method as set forth in claim 8 wherein each of the electrodes has an edge facing the other which has a substantially, squared and stepped configuration.

13. A cathode ray tube comprising:

a funnel with a pair of opposing ends, an inner surface, and an outer surface;

a faceplate secured to one of the opposing ends of the funnel, the faceplate having inner and outer surfaces;

a pair of first capacitor plates disposed on the inner surface of the funnel;

a pair of second capacitor plates disposed on the outer surface of the funnel, each of the second capacitor plates being disposed opposite one of the first capacitor plates; and at least one pair of electrodes formed on the inner surface of the faceplate, each pair of electrodes being spaced apart a first distance, one of the electrodes being coupled to one of the first capacitor plates and the other electrode being coupled to the other first capacitor plate.

14. The cathode ray tube as set forth in claim 13 further comprising an electron gun located in the other one of the opposing ends of the funnel.

15. The cathode ray tube as set forth in claim 14 further comprising a deflection drive coupled to the funnel adjacent to the electron gun.

16. The cathode ray tube as set forth in claim 13 wherein each of the electrodes extends in a substantially horizontal direction across the faceplate and each of the electrodes has an edge facing the other which has a substantially saw-tooth configuration.

17. The cathode ray tube as set forth in claim 13 wherein each of the electrodes extends in a substantially horizontal direction across the faceplate and each of the electrodes has an edge facing the other which has a substantially, squared and stepped configuration.

18. The cathode ray tube as set forth in claim 13 wherein each of the electrodes extends in a substantially horizontal direction across the faceplate and each of the electrodes has an edge facing the other which is substantially straight.

* * * * *